US007244105B2

(12) United States Patent
Moeller

(10) Patent No.: US 7,244,105 B2
(45) Date of Patent: Jul. 17, 2007

(54) BLADE RETENTION ARRANGEMENT

(75) Inventor: Tim Moeller, Berlin (DE)

(73) Assignee: Rolls-Royce Deutschland Ltd & Co KG, Blakenfelde-Mahlow (DE)

( * ) Notice: Subject to any disclaimer, the term of this patent is extended or adjusted under 35 U.S.C. 154(b) by 101 days.

(21) Appl. No.: 10/842,448

(22) Filed: May 11, 2004

(65) Prior Publication Data

US 2005/0084376 A1 Apr. 21, 2005

(30) Foreign Application Priority Data

Oct. 16, 2003 (DE) ..... 103 48 198

(51) Int. Cl.
*F01D 5/32* (2006.01)
*F04D 29/34* (2006.01)

(52) U.S. Cl. ..... 416/220 R; 416/221

(58) Field of Classification Search ..... 416/219 R, 416/220 R, 221

See application file for complete search history.

(56) References Cited

U.S. PATENT DOCUMENTS 3,656,865 A 4/1972 Spears, Jr.

4,730,983 A * 3/1988 Naudet et al. ..... 416/220 R

FOREIGN PATENT DOCUMENTS

| | | |
|---|---|---|
| DE | 1830030 | 4/1961 |
| EP | 0761930 A1 | 3/1997 |
| GB | 2258273 | 2/1993 |

* cited by examiner

*Primary Examiner*—Edward K. Look
*Assistant Examiner*—Dwayne J White
(74) *Attorney, Agent, or Firm*—Timothy J. Klima

(57) ABSTRACT

A blade retention arrangement axially fixes blades (1) to a disk (2). A profiled blade root (3) extending from the airfoil is inserted into a conformal axial slot (5) in the disk (2) and is axially secured by means of a split retaining ring (4), with the retaining ring (4) at least partly engaging a groove (6) on the blade root (3). The disk (2) is provided with a circumferential annular groove (7) which has a radially inward seating face for the retaining ring (4) and the retaining ring (4) is elastically deformable at least in the axial direction.

20 Claims, 5 Drawing Sheets

BLADE RETENTION ARRANGEMENT

This application claims priority to German Patent Application DE10348198.2 filed Oct. 16, 2003, the entirety of which is incorporated by reference herein.

BACKGROUND OF THE INVENTION

This invention relates to a blade retention arrangement. More particularly, the present invention relates to a blade retention arrangement for the axial fixation of blades to a disk of a gas turbine, in which a profiled blade root extending from the airfoil is inserted into a conformal axial slot in the disk and is axially secured by means of a split retaining ring, with the retaining ring at least partly engaging a groove on the blade root.

A blade retention arrangement is shown in U.S. Pat. No. 6,234,756 B1, for example. Furthermore, a great variety of solutions for the axial fixation of blades is known from the state of the art, with a distinction being made between blades for compressors and those for turbines. Each of these embodiments has its specific disadvantages, these calling either for particular design prerequisites or being incompatible with specific design solutions.

BRIEF SUMMARY OF THE INVENTION

The present invention, in a broad aspect, provides a blade retention arrangement of the type described at the beginning which, while being simply designed and easily and cost-effectively usable, is readily installable and takes only little space.

It is a particular object of the present invention to provide solution to the above problems by a combination of the features described herein. Further advantageous embodiments of the present invention will become apparent from the description below.

The present invention, accordingly, provides for a disk that includes a circumferential annular groove which has an axially inward seating face for the retaining ring and that the retaining ring is elastically deformable at least in the axial direction.

The blade retention arrangement according to the present invention has a variety of merits.

The blade retention arrangement according to the present invention also lends itself for installation into a multi-stage welded rotor in which at least one stage includes rotor blades whose blade roots have an exit opening (micro-turbine).

The present invention provides for a favorable introduction of the centrifugal forces beneath the blade root and, thus, for a low weight of blade and disk. This also contributes positively to the life of the entire arrangement.

The simple design of the components of the blade retention arrangement according to the present invention provides for low costs. Here, it is particularly favorable that the retaining ring can be made in sheet metal, in contrast to the expensive forgings known from the state of the art.

Also, the present invention enables the blade retention arrangement to be designed aerodynamically, this resulting in minor flow turbulence and, hence, in low flow losses.

A further, significant advantage lies in the fact that installation and removal of the arrangement can be accomplished easily and quickly, and in the cost savings resulting therefrom.

Furthermore, in accordance with the present invention, it is advantageous that the risk of damage to the disk during the installation of the blade retention arrangement can be reduced to zero.

Installation of the blade retention arrangement according to the present invention ensures high repeatability and, thus, high component reliability.

In a favorable development of the present invention, the annular groove is provided with at least one entry. This entry enables the retaining ring to be inserted or removed easily and damage-free.

It is particularly favorable if the retaining ring is made of two or more layers of a metallic material joined to each other at one end of the retaining ring. This increases the elasticity of the retaining ring considerably. The increased elasticity enables the retaining ring to be inserted into the groove and seated in it without distortion.

It is particularly advantageous if the retaining ring is provided with an anti-rotation lock which prevents the retaining ring from moving circumferentially. The anti-rotation lock is, in a preferred form, provided as a radial tang on the retaining ring and is preferably arranged at an end of said ring. This enables the retaining ring to be inserted and secured by way of the anti-rotation lock.

It is particularly favorable if the retaining ring has a strip-shaped cross-section. Such a rectangular cross-section will ensure that the retaining ring enters sufficiently into the groove of the blade root or the disk, respectively.

According to the present invention, the retaining ring can be divided circumferentially into several segments, for example six segments.

BRIEF DESCRIPTION OF THE DRAWINGS

The present invention is more fully described in the light of the accompanying drawings showing an embodiment. In the drawings.

DETAILED DESCRIPTION OF THE INVENTION

This detailed description should be read in conjunction with the summary of the invention above.

Figure 1:
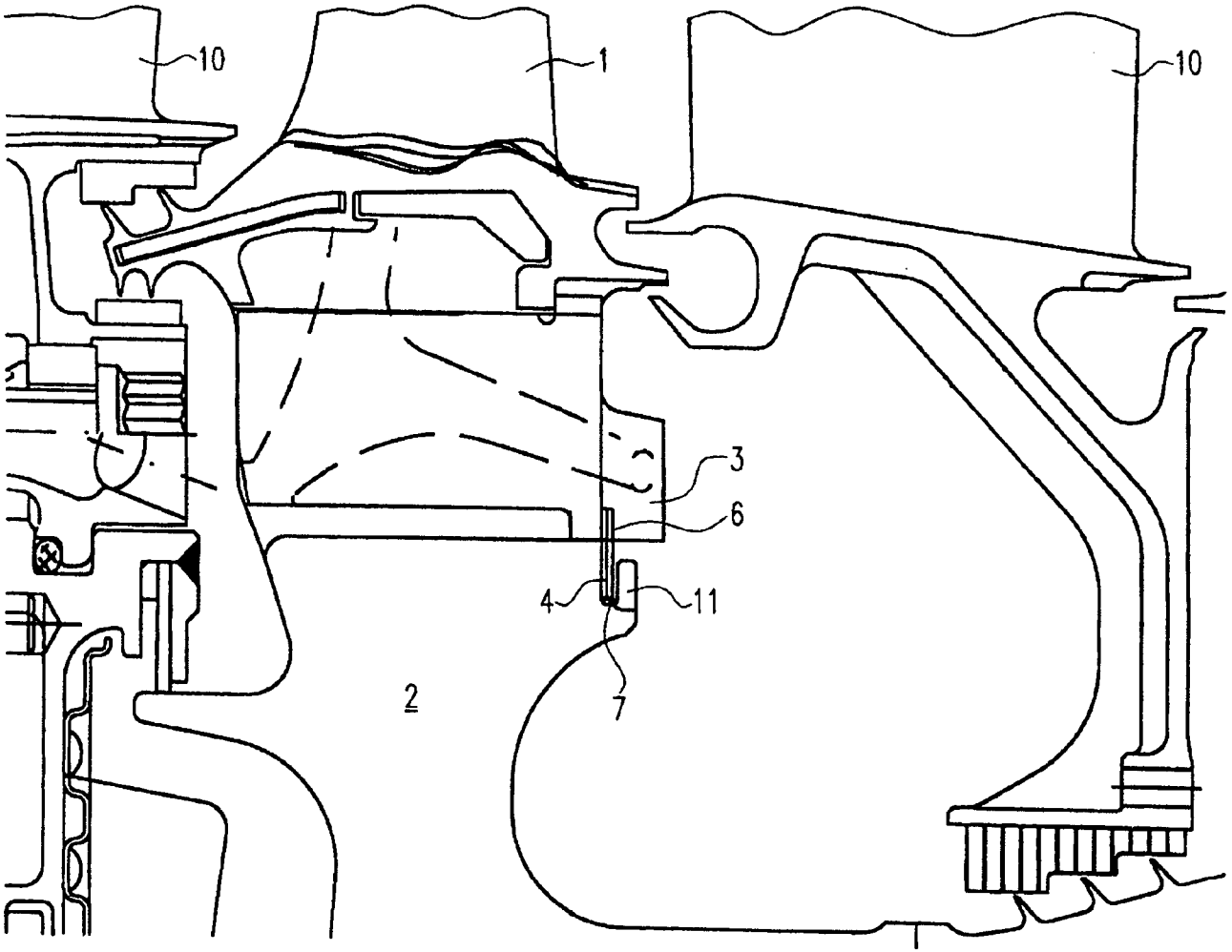
FIG. 1 is a schematic partial sectional side view of the installation situation of the blade retention arrangement according to the present invention.

FIG. 1 is a simplified representation of a rotatably borne disk 2 of a gas turbine engine carrying several blades 1. Adjacent stator vanes are designated with the reference numeral 10. As regards the general design, reference is made to the state of the art, so that a further description can be dispensed with herein.

Figure 4:
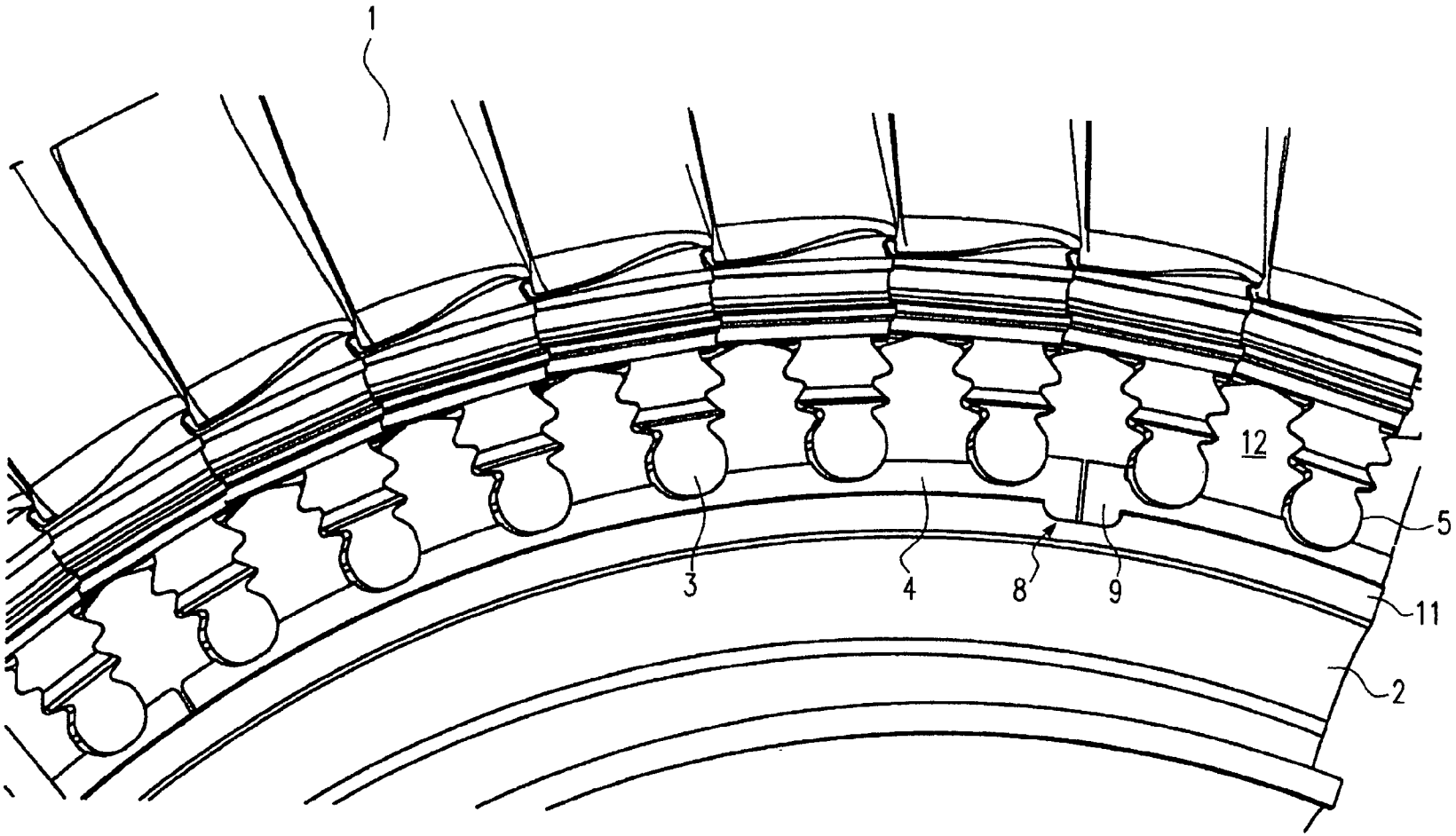
FIG. 4 is an axial partial view of the blade retention arrangement according to the present invention in the installed state.
Figure 5:
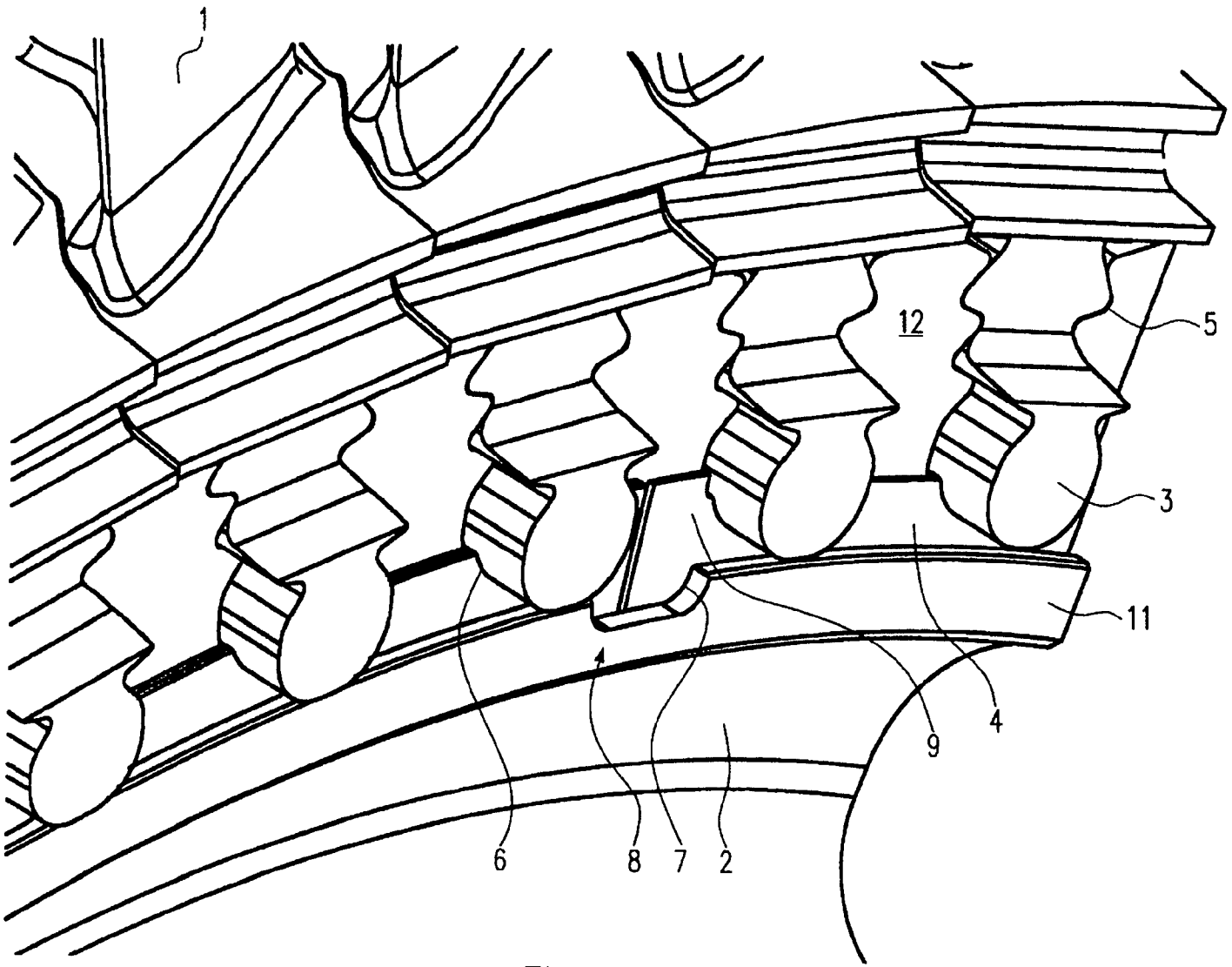
FIG. 5 is a perspective partial view of the situation shown in FIG. 4.

As shown in FIGS. 4 and 5, in particular, the blades 1 each have a blade root 3 with a profile which is insertable into a profiled axial slot 5 of the disk 2. As regards the detailed design, reference is again made to the state of the art.

The bottom areas of the blade roots 3 are each provided with a circumferential groove 6.

The disk 2, as becomes apparent from FIG. 1 in particular, features an annular groove 7 which is open in the radial outward direction and, as shown in FIG. 1, is provided with a retaining leg 11.

Figure 6:
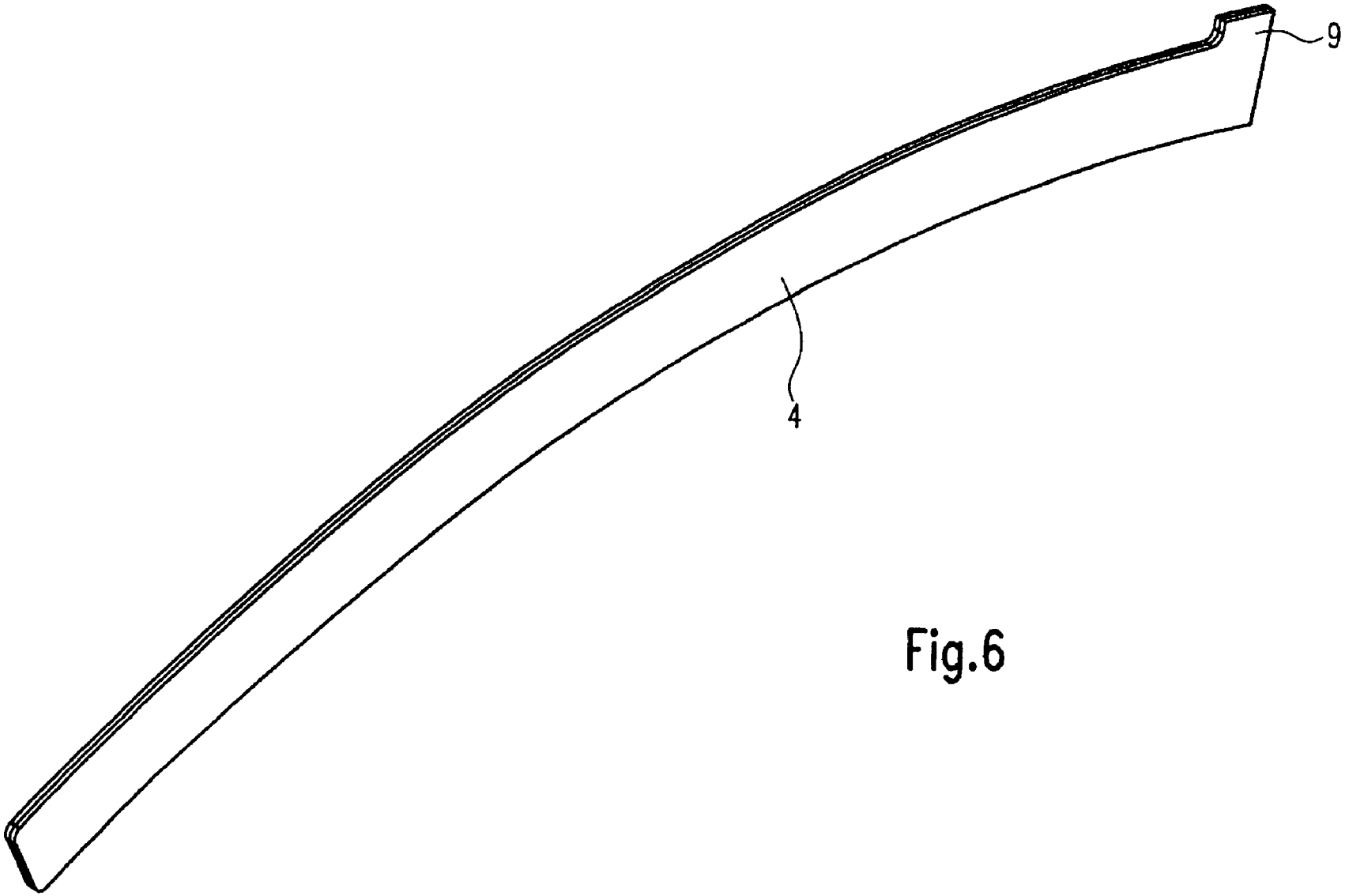
FIG. 6 is a perspective view of the retaining ring according to the present invention.

The blade retention arrangement according to the present invention further comprises a segmented retaining ring 4 which is provided, at its free end, with a radially outward tang 9 (see FIG. 6, in particular). Each retaining ring segment preferably retains a plurality of blades. In one embodiment, the retaining ring 4 includes six segments, but this can be altered as desired. In an alternative embodiment, the retaining ring 4 need not be provided in segments but can be a single split ring.

Figures 2, 3:
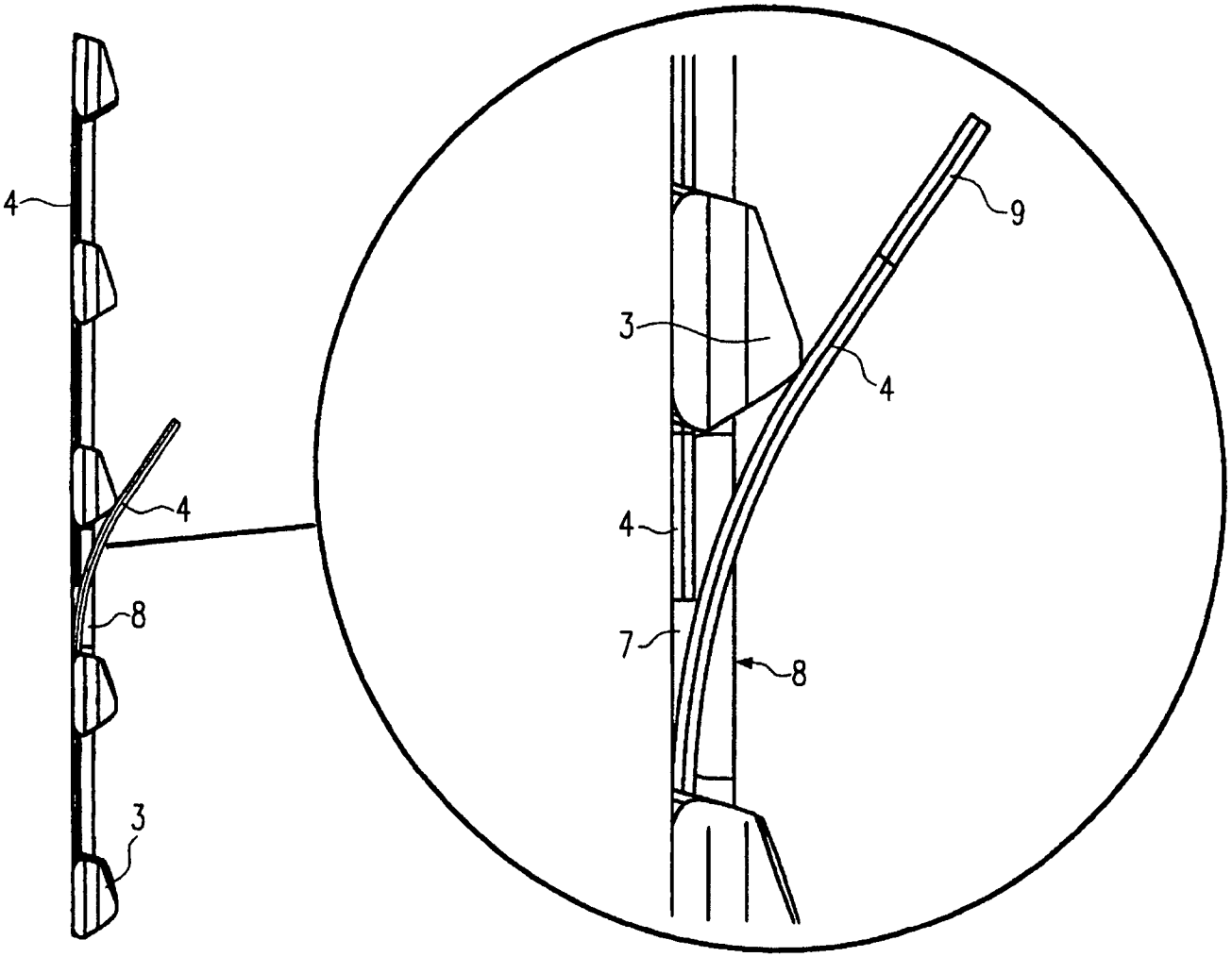
FIG. 2 is an enlarged radial partial view of the installation process of the retaining ring, seen from outside.
FIG. 3 is an enlarged representation of the view of FIG. 2.

The annular groove 7 has one or more entries 8 in the form of a recess in the retaining leg 11. These entries 8 enable the axially elastically deformable retaining ring 4 to be inserted, as becomes apparent from FIGS. 2 and 3. Preferably, an entry 8 is provided for each retaining ring segment. Thus, during installation, the two sheet-metal layers (see FIGS. 2 and 3) of the retaining ring 4 are elastically deformed and threaded into the grooves 6 and 7 via the entry 8. The entry 8, as already mentioned, is a recess in the lower annular groove 7.

If upper disk-side grooves are to be provided on the so-called disk lobes 12 (see FIG. 5), these upper disk-side grooves would also have to be provided with appropriate entries.

Upon insertion, the retaining ring 4, due to its elasticity, will snap into place, and thus be secured, in the grooves 6 and 7. This spring elasticity of the retaining ring 4 arises from its multi-layer construction. For this purpose, the retaining ring 4, as already mentioned, is made up of two or more layers which are joined to each other at one end, for example by welding. The weld can, for example, be made at the end at which the anti-rotation lock in the form of the tang 9 is provided. It is also possible to fold sheet-metal strips to obtain the two-layer form shown. By joining the layers together at one end while allowing the layers to be free at the other end greatly increases the spring elasticity of the retaining ring 4 by allowing the free ends of the layers to slide with respect to one another as the retaining ring 4 is elastically deformed. In an alternative embodiment, the retaining ring can be constructed of a single piece of material providing the desired properties.

Various of the aspects of the present invention can be combined in different manners to create new embodiments.

List of Reference Numerals

1 blade
2 disk
3 blade root
4 retaining ring
axial slot of 2
6 groove of 3
7 annular groove
8 entry
9 tang
10 stator vane
11 retaining leg
12 disk lobe

What is claimed is:

1. A blade retention arrangement for the axial fixation of blades to a disk, in which a profiled blade root extending from one of the blades is inserted into a conformal axial slot in the disk and is axially secured comprising:

a groove on the blade root;

a split retaining ring, the retaining ring at least partly engaging the groove on the blade root, the retaining ring being elastically deformable in at least an axial direction of the disk; and a circumferential annular groove provided on the disk which includes a radially inward seating face for accepting the retaining ring, wherein the annular groove includes at least one axially opening entry circumferentially positioned between adjacent blade roots for inserting the retaining ring into the annular groove when the retaining ring is elastically deformed in the axial direction.

2. A blade retention arrangement in accordance with claim 1, wherein the retaining ring includes at least two layers which are connected to each other at one circumferential end of the retaining ring and free with respect to each other at another circumferential end of the retaining ring.

3. A blade retention arrangement in accordance with claim 2, and further comprising an anti-rotation lock for the retaining ring.

4. A blade retention arrangement in accordance with claim 3, wherein the anti-rotation lock comprises a radial tang on the retaining ring.

5. A blade retention arrangement in accordance with claim 4, wherein the anti-rotation lock is positioned at an end of the retaining ring.

6. A blade retention arrangement in accordance with claim 5, wherein the retaining ring has a strip-shaped cross-section.

7. A blade retention arrangement in accordance with claim 6, wherein the retaining ring is circumferentially divided into segments.

8. A blade retention arrangement in accordance with claim 7, wherein each retaining ring segment comprises:

at least two layers which are connected to each other at one end of the segment; and an anti-rotation lock in the form of a radial tang positioned at an end of the segment.

9. A blade retention arrangement in accordance with claim 1, wherein the retaining ring includes at least two layers which are connected to each other at one end of the retaining ring.

10. A blade retention arrangement in accordance with claim 1, and further comprising an anti-rotation lock for the retaining ring.

11. A blade retention arrangement in accordance with claim 10, wherein the anti-rotation lock comprises a radial tang on the retaining ring.

12. A blade retention arrangement in accordance with claim 11, wherein the anti-rotation lock is positioned at an end of the retaining ring.

13. A blade retention arrangement in accordance with claim 1, wherein the retaining ring has a strip-shaped cross-section.

14. A blade retention arrangement in accordance with claim 1, wherein the retaining ring is circumferentially divided into segments.

15. A blade retention arrangement in accordance with claim 14, wherein each retaining ring segment comprises:

at least two layers which are connected to each other at one end of the segment; and an anti-rotation lock in the form of a radial tang positioned at an end of the segment.

16. A retaining ring for retaining a blade to a disk in a turbine, comprising:

at least two layers which are connected to each other at one circumferential end of the retaining ring and free with respect to each other at another circumferential end of the retaining ring to increase a spring elasticity of the retaining ring, the retaining ring being constructed and arranged to be elastically deformable in at least an axial direction of the disk to be inserted into both a groove on the blade root and a circumferential annular groove provided on the disk, wherein, elastic deformation of the retaining ring in the axial direction causes at least one of the free ends of the two layers to move circumferentially with respect to the other of the free ends.

17. A retaining ring in accordance with claim 16, and further comprising an anti-rotation lock.

18. A retaining ring in accordance with claim 17, wherein the and-rotation lock comprises a radial tang.

19. A retaining ring in accordance with claim 18, wherein the anti-rotation lock is positioned at an end of the retaining ring.

20. A blade retention arrangement for the axial fixation of blades to a disk, in which a profiled blade root extending from one of the blades is inserted into a conformal axial slot in the disk and is axially secured comprising:

a groove on the blade root;

a split retaining ring, the retaining ring at least partly engaging the groove on the blade root, the retaining ring being elastically deformable in at least an axial direction of the disk;

a circumferential annular groove provided on the disk which includes a radially inward seating face for accepting the retaining ring; and an anti-rotation lock for the retaining ring, the anti-rotation lock comprising a radial tang positioned at an end of the retaining ring.

* * * * *